US007080679B2

(12) United States Patent
Bech

(10) Patent No.: US 7,080,679 B2
(45) Date of Patent: Jul. 25, 2006

(54) ADAPTIVE CONTROL OF MOULD COMPRESSIBILITY

(75) Inventor: Christian Munkholm Bech, Charlottenlund (DK)

(73) Assignee: DISA Industries A/S, Herlev (DK)

( * ) Notice: Subject to any disclaimer, the term of this patent is extended or adjusted under 35 U.S.C. 154(b) by 0 days.

(21) Appl. No.: 10/499,368

(22) PCT Filed: Dec. 20, 2001

(86) PCT No.: PCT/DK01/00856

§ 371 (c)(1),
(2), (4) Date: Jun. 18, 2004

(87) PCT Pub. No.: WO03/053610

PCT Pub. Date: Jul. 3, 2003

(65) Prior Publication Data

US 2005/0034833 A1 Feb. 17, 2005

(51) Int. Cl.
*B22C 11/10* (2006.01)

(52) U.S. Cl. ..... 164/456; 164/18; 164/155.1

(58) Field of Classification Search ..... 164/456, 164/154.1, 155.1, 18
See application file for complete search history.

(56) References Cited

U.S. PATENT DOCUMENTS

| | | | | |
|---|---|---|---|---|
| 4,248,290 | A | 2/1981 | Hermes | |
| 4,437,507 | A * | 3/1984 | Seeley | 164/173 |
| 4,791,974 | A | 12/1988 | Larsen | |
| 4,853,868 | A | 8/1989 | Medwin | |
| 5,332,025 | A * | 7/1994 | Larsen | 164/456 |

* cited by examiner

*Primary Examiner*—Len Tran
(74) *Attorney, Agent, or Firm*—Douglas E. Jackson; Stites & Harbison PLLC

(57) ABSTRACT

In a mold producing foundry machine generally according to the "Disamatic®"-principle a method of compensating for relatively slowly varying compaction properties of the mold particle material without compromising the geometrical requirements for repeatedly fixed placements of the pattern plates defining the mold chamber before the shot, comprises previous establishment of a beneficial set of starting parameters for shot and pressing of the mold to a fix terminating compaction force. The percentual volume reduction from the fixed starting volume to the terminating volume of the compacted mold—yielding the mold compressibility—is compared to the previously established beneficial reference value and the succeeding shots are adaptively controlled to compensate for the realised offset in compressibility by especially regulating the shot pressure, duration and fluidization parameters in a cyclic sequence securing steady reduction of the offset value to be within acceptable margins. The invention also comprises a related apparatus.

4 Claims, 3 Drawing Sheets

ADAPTIVE CONTROL OF MOULD COMPRESSIBILITY

TECHNICAL FIELD

The present invention relates to a method for producing a series of casting moulds or flaskless substantially horisontally stack-able mould parts, generally according to the commonly well known "Disamatic®"-principle, taking into account relatively slowly varying compaction properties of the particle material used.

The present invention also relates to an apparatus for carrying out the method of the present invention.

BACKGROUND ART

The compaction properties is of importance in producing moulds of a suitable compactness. A loosely compacted (i.e. too low compaction ratio) mould will easily be damaged during handling before casting or during the casting operation itself. A low compacted mould might thus result in defective castings or in leaks of molten metal damaging the equipment. On the other hand an excessively compacted (i.e. too high compaction ratio) mould will have a low gas permeability consequently endangering entrapment of gases in the castings, thus creating porosities or even hazardous mould blow-outs.

PRIOR ART

A method of the kind specified in the preamble is known from U.S. Pat. No. 5,332,025-A (Larsen). According to this method, compensation for the drift in compaction properties of the particle material used consists in the volume of the moulding chamber being measured/computed, before and after the compacting step of the brought in particle material. The values obtained are used to calculate a compaction ratio, which is compared to a desired compaction ratio, yielding basis for making adjustments of the production parameters (especially lengthsize of mould chamber volume ready for filling and/or and compacting pressure) for the next mould (part). In this manner it is possible to achieve a continuous compensation for the drift in compacting properties.

Even though a reference compaction ratio value previously has been established for a given set of pattern plates actually correspondingly lining respectively the two movable opposed walls in the generally box-shaped mould chamber, and this reference value is used for the above parameter adjustments, the cited prior art method results in a major drawback as the lengthwise "floating" character of the adjustable "before the shot" mould chamber volume is conflicting with requirements from intricate pattern plates, especially with substantially overhanging pattern sections, which demand specific placement compared to the particle material inlet to secure adequate material deposition especially in the "shadowed" regions below overhangs during the introduction of the particle material (i.e. "during the shot").

SUMMARY OF THE INVENTION

The object of the present invention is thus to provide a method to control production of moulds with adaptively optimized compressed particle material pouring/degassing characteristics, taking into account the drift in compaction properties of the particle material used, without compromising the geometrical requirements dictated from the particular set of pattern plates currently in use, namely geometrical requirements both to initial size and placement relative to the particle material inlet of the closed not-yet-filled mould chamber volume, and to the compressed volume of the resulted mould.

To this purpose the term "mould compressibility" is Introduced meaning the reduction percentage from the first of the two just mentioned volumes to the latter thereof (i.e. (volumes difference)/(initial volume) %).

In other words the object of the method according to the present invention is to provide moulds with realized "mould compressibility" values corresponding to a previously established specific reference value, whereas the detected deviation value (i.e. "the offset") adaptively is used as an input to control parameters to further reduce/keep at minimum the offset in the detected mould compressibility value for moulds to be subsequently produced by controlling the step of particle material introduction into the mould chamber.

The present invention also relates to an apparatus for carrying out the method of the present invention.

The advantages of the present invention consists in remedy of the mentioned drawbacks by elimination to minimum of the variations in compacted mould quality resulting from the relatively slowly varying character of the properties of the particle material used, obeying at the same time the geometrically related requirements dictated from the set of pattern plates actually in use, the present invention thus yielding more uniform quality of successive moulds, more uniform quality castings, and safer foundry operation.

An apparatus generally according to the "Disamatic®"-principle is fitted with the pattern plates actually constituting a given set of corresponding pattern plates lining respectively the two movable opposed walls in the generally box-shaped mould chamber in the apparatus.

According to the present invention:

1.a: The movable walls are, along their common axis of linear motion, placed at individually specific positions, relative to a particle material introduction (theoretical, reference) "point", thus defining a specific position for each of the pattern plates, such position being reproducible and being previously established as being beneficial. The placements to this set of specific starting positions is performed before each new "shot" (introduction of particle material) into the mould chamber, meaning the mould chamber has the same volume and position relative to the material introduction "point" before each succeeding shot.

2.a: Particle material is introduced into the mould chamber defined as just revealed, the amount of introduced material being controlled by especially the duration of the shot and/or the driving gas pressure, these values initially being set according to beneficial reference values previously established as preferable starting values, these values later being possibly adjusted according to a dominating adaptive controlling procedure.

3.a: Pressing of the Introduced particle material by relative approach of the movable walls according to known procedures, the pressing step terminating at a specific pressing force/pressure, i.e. a fixed value previously being established as beneficial.

4.a: Determination of the volume of the just pressed mould by determination of the distance between the movable walls after termination of the pressing step.

5.a: Dislocation of the just pressed mould for later pouring with molten material, according to known procedures, ending with the movable walls again defining the mould chamber according to above paragraph ref. 1.a.

5.b1: Calculating the resulted compressibility of the just pressed mould and the compressibility offset relative to the previously established beneficial reference value for the desired mould compressibility.

5.b2: According to an adaptive procedure determination of the possibly necessary adjustment(s) of the parameter(s) for shot duration and/or shot driving gas pressure(s) to reduce to/keep within specified limiting values the compressibility offset expected for the next mould produced.

5.b3: Adjusting the apparatus according to the decisions in ref. 5.b2.

6.a: Repeating the steps from ref. 2.a, executing a next shot with possibly adjusted parameters.

—.c: Terminating the loop between ref. 2.a and ref. 6.a at a suitable position/point of time in the operation cyclus of the apparatus.

In the above paragraphs the numerical prefix is dominating the suite of execution of the operations mentioned; different letter suffixes to same number indicate individual "strings" of operations, that are executed "in parallel", whereas a numerical suffix to a letter Indicate the placement in the series covered by that letter suffixing a specific number.

Of course, necessary secondary operations are also required to carry out the above method according to the present invention, e.g. storing of values, introduction of offset/reference values specific to the apparatus and pattern plates used, measuring, calculating, using conversion factors, algorithms and tables, decision and controlling actions (logical as physical), etc, besides the operation of the apparatus as such. These evident operations are known to the persons skilled in the art and will not be further discussed In the present application.

Advantageous embodiments of the method and of the apparatus according to the present invention are revealed in the appending claims and/or are explained in the following detailed portion of the present specification with reference to the belonging drawing.

BRIEF DESCRIPTION OF THE DRAWING FIGURES

The drawing accompanying this application consists of 3 figures, whereras:

DESCRIPTION OF THE PREFERRED EMBODIMENT

The invention is related to a foundry machine functioning according to the generally well known "Disamatic®"-principle; should the reader be unfamiliar with such apparatus and the functioning thereof, explanation can be found in the above mentioned U.S. Pat. No. 5,332,025.

Hereinafter the reader is assumed being familiar with the overall principles and functioning related to the "Disamatic®"-tern; these will therefore not be further discussed here.

Figure 1:
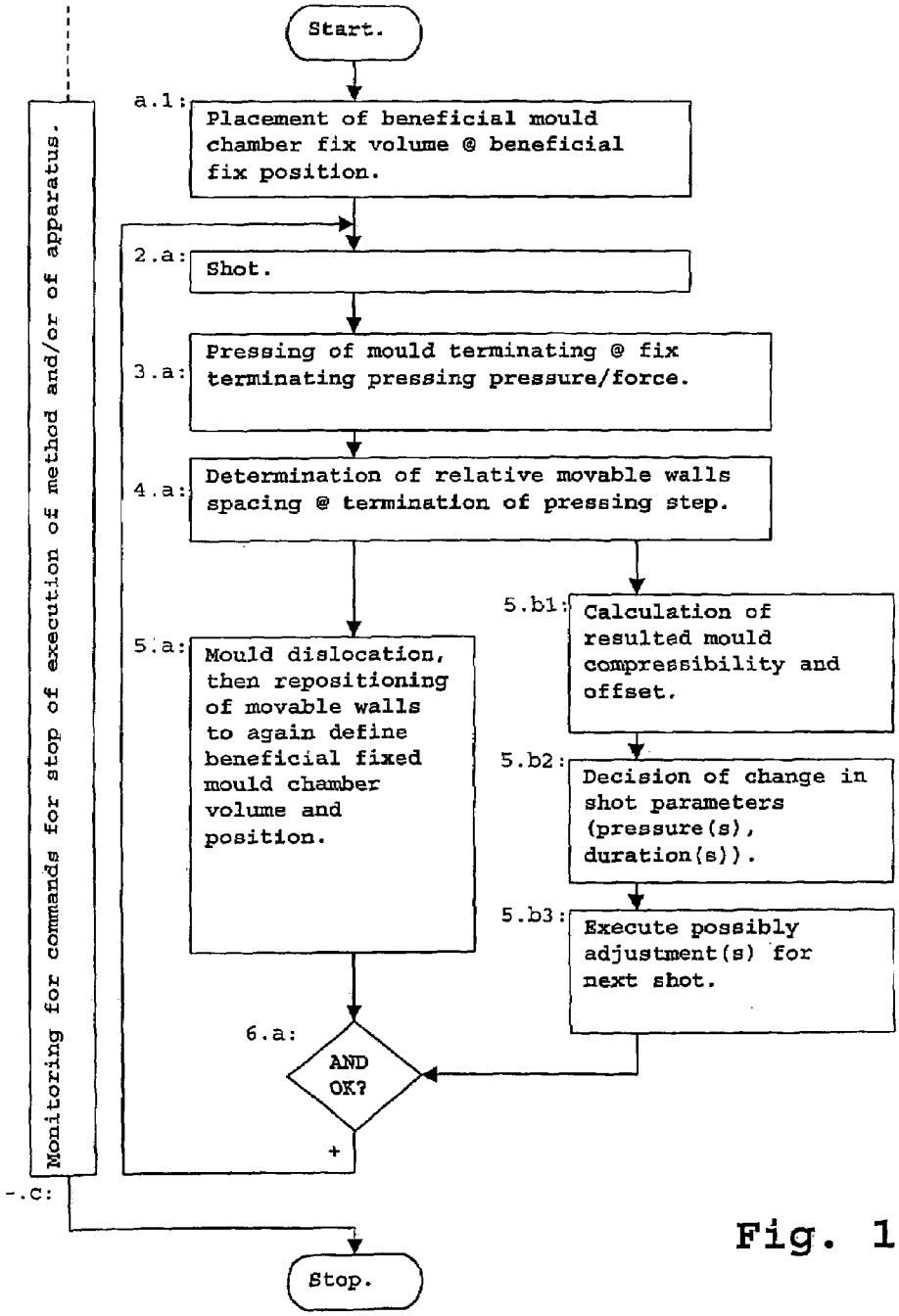
FIG. 1 shows a diagrammatic flow-chart, illustrating the steps of the method according to the present invention.

In FIG. 1 the method according to the present invention is schematically shown as a flow-chart with the significant steps noted in respective "boxes"; the direction from top to bottom of the drawing plane of FIG. 1 can qualitatively be taken as an axis of progressing time, the corresponding minor steps within parallel series of steps being ranked via the suffixed letters and digits as explained earlier.

Figure 2:
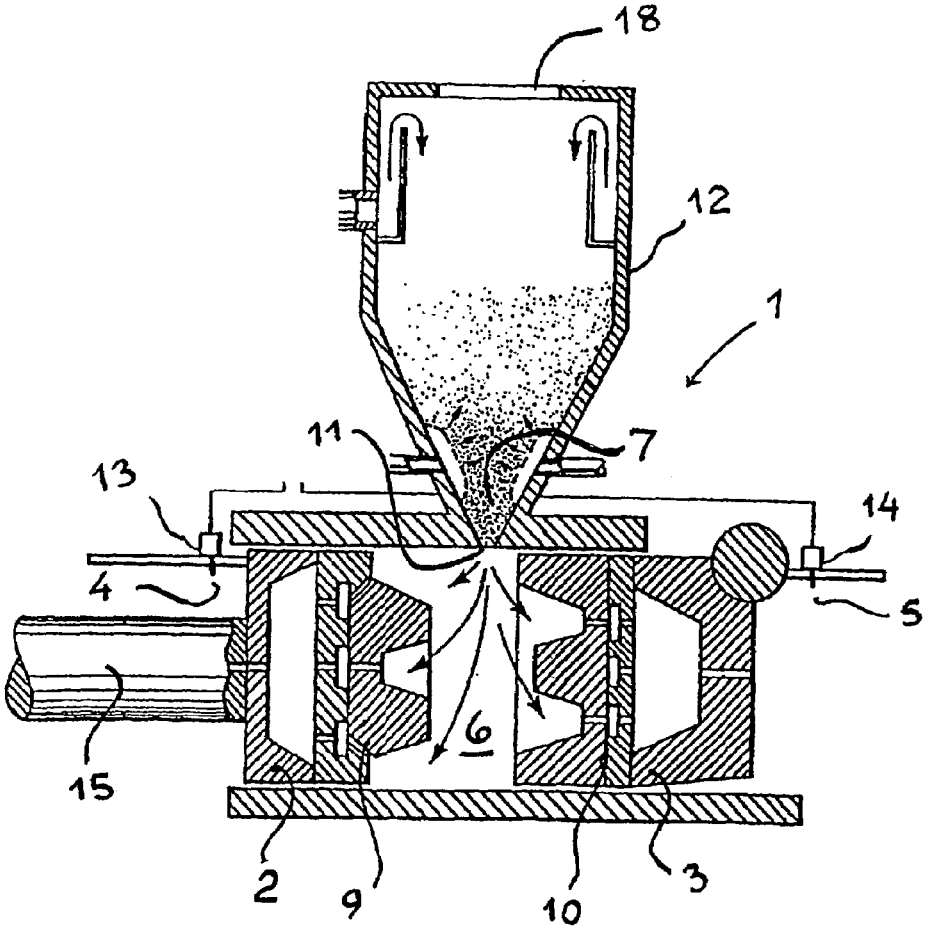
FIG. 2 shows, in vertical section, a schematic cut-out of an apparatus according to the present invention performing the method according to the present invention, in the situation just before introduction of particle material, the opposed movable walls thus indirectly defining the before-shot mould chamber volume, previously being established as being beneficial to the pattern plates used.
Figure 3:
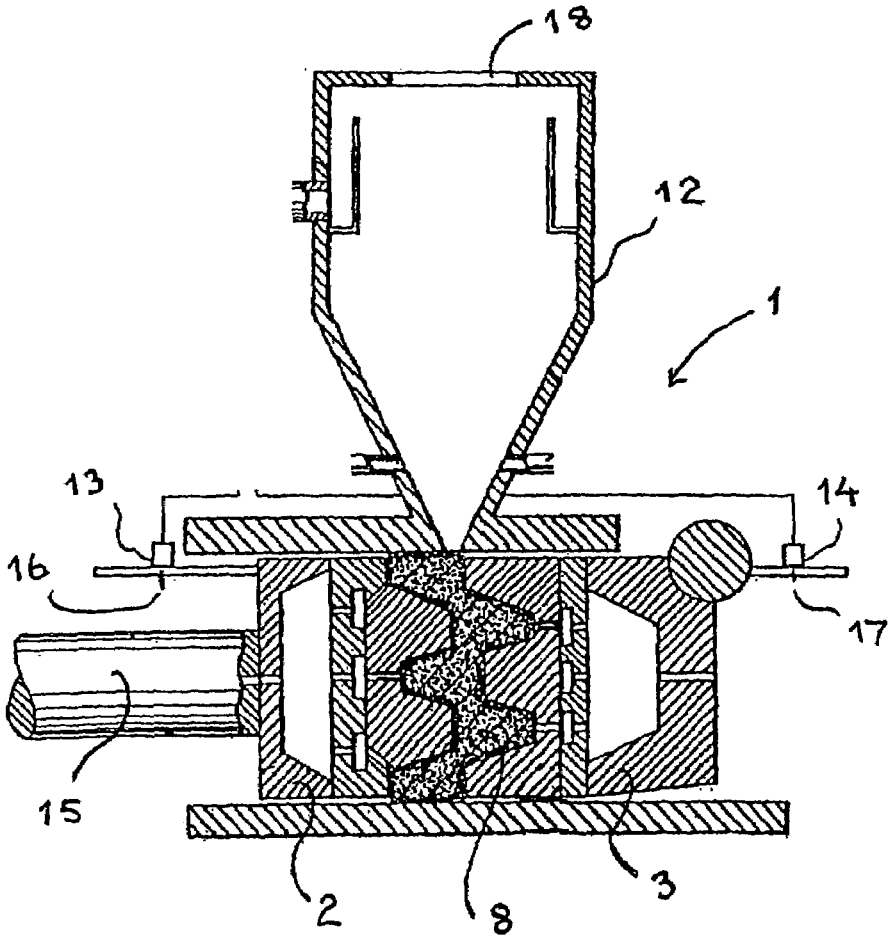
FIG. 3 shows, in vertical section, the cut-out apparatus of FIG. 2 at the termination of the pressing step of the particle material Introduced, the opposed movable walls now indirectly defining the volume of the compacted mould, used for calculating the resulted compressibility of the mould, etc.

The following description of the steps in FIG. 1 will be given with reference to the physical "world", which via the schematic machine in different situations is illustrated in FIGS. 2 and 3, thus giving a thorough understanding of the invention.

Re. FIG. 1 the action specified in the box representing the step a.1 of the method according to the present invention has resulted in, see FIG. 2, placement of the first 2 and the second 3 movable walls of the apparatus 1 according to the "Disamatic®"-principle in respective positions at respective sides to the particle material inlet opening 11, thus by the space between the opposed surfaces of the pattern plates 9, 10 defining a mould chamber 6, which of volume and position relative to the inlet opening 11 has been found beneficial to this set of pattern plates 9, 10 actually lining the movable walls 2, 3 respectively. The beneficial mould chamber size and position is mainly influenced by the geometrical shapes of the opposed surfaces of the set of pattern plates actually used, as e.g. a pattern with a substantially protruding overhang, as seen on plate 9, results in difficulty in effectively filling the bottom area below, that is "shadowed" from the inlet opening 11 by the overhang, thus possibly requiring the mould chamber size and position being optimized by moving the wall 2 with the adjacent pattern plate 9 to a new resting position to the left in FIG. 2. Other important parameters influencing the beneficial size and position are the properties of the sand utilized and the pressures and their durations of the driving and fluidizing gas in the pressurizable material hopper 12 during the introduction of particle material 7 from the hopper 12 into the mould chamber 6. The goal is to achieve an adequate material filling everywhere of the beneficial volume yielding a high quality mould (parts block) after pressing. Therefore the beneficial volume size and position are correlated to optimum values of the pressure and time parameters of the "shot" for an actual profile of sand properties.

The set of beneficial/optimal values is often established during laboratory-type simulating tests remote from the actual pouring line. Preferably, the determination of the beneficial parameter set might be bettered, if the tests are carried out on a machine similar to the machine used for production, and most preferably such tests are performed on the actual production machine supplied with sand of production type and quality to give the most realistic determination of the set of beneficial setting-values.

The beneficial volume and position of the mould chamber 6 are indirectly established by monitoring the absolute positions along their common axis of linear movement of the two movable walls 2, 3 by means of the two detectors 13, 14 respectively. Thus the beneficial size and position of the mould chamber are established before each shot by controlling the movement of each movable wall 2, 3 to stop at the absolute position 4, 5 respectively. Knowing the machine-size-defined fix height and fix width (perpendicular to the drawing plane of FIG. 2) of the mould chamber 6, the real size of the volume, e.g. expressed in the unit $dm^3$, is easily calculated from the absolute spacing in the length direction between the positions 4 and 5 taking into account biasing by the fix length offsets to the opposed surfaces of the movable walls 2, 3 and by the geometrical volume of the pattern plates mounted adjacently.

Next the shot (FIG. 1, box 2.a) is performed, during which the particle material 7 in the hopper 12 by means of the driving gas and the fluidizing gas is forced from the hopper 12 through the inlet opening 11 into the mould chamber 6 as illustrated with respective arrows in FIG. 2. During the shot the pressures and durations of the driving and fluidizing gas are controlled according to a "receipt" and the beneficial values earlier established.

Turning now to FIG. 1 box 3.a and FIG. 3, the brought in particle material in the mould chamber is compressed to a relatively solid block 8 by relatively approaching the movable walls 2, 3. Such compression terminating the pressing step, when the fix ending pressing force (that could be related to a pattern-plate-dependant fix hydraulic pressure in a cylinder exerting a force on a piston of fix geometry) no longer cause relative movement of the two movable walls 2, 3. The actual terminating absolute positions 16, 17 in the length direction of the movable walls 2, 3 respectively are measured using the respective detectors 13, 14 once more.

Known movements, etc. necessary to dislocate the mould 8 from the machine 1 and reposition the movable walls 2, 3 to once more define the beneficial size and position of the mould chamber 6 (see FIG. 1 again) by being stopped at respective positions 4, 5 are now executed re. FIG. 1 box 5.a. Before a next shot particle material is possibly also added into the hopper 12 through a top supply opening 18, which especially during a shot can be closed and sealed by controlled use of known means not further discussed here. This step 5.a of the method according to the present invention is terminating by the machine 1 being physically prepared for a next shot into a mould chamber 6 of same beneficial size and position as the previous one.

During the execution of step 5.a a series of especially calculating, deciding and adjusting actions are performed at the control-system-level of the machine 1. Whatever the kind of the control system (not further detailed here), according to the invention at least the compressibility of the just produced mould 8 is calculated by relating the actual set of pressing-terminating readings 16, 17 from the detectors 13, 14 to the fix initial volume of the mould chamber 6, represented by the fix position-values 4, 5 corrected from biasing fix length and fix volume components. Thus the mould compressibility defined as (volumes difference)/(initial volume) % of the just produced mould is calculated and a value set representing the result is stored. In step/box 5.b1 (FIG. 1) also the offset of the just calculated compressibility from a beneficial compressibility value, which also has been evaluated during previous (laboratory-like) tests, is calculated by the control system and stored by some representative data set. Re. step/box 5.b2 next, resulting from some adaptively operating algorithm(s) working on the recently realized offset value(s) in relation to the set of established beneficial relevant parameter values, later adaptations hereof caused by previously decided parameter adjustments according to the present invention, and an offset tolerance band, representing the desired mould equality during the mould production run, is worked out a decision whether to adjust shot parameter(s) or not. After the calculations and decisions in step 5.b2, the decided possible adjustments are executed in step 5.b3 of the method according to the invention. The general principle for the adjustments prescribes:

a) realised compressibility value too high→more intense compaction of particle material shot into the mould chamber required→augmented driving pressure, change in fluidizing behavior and/or longer shot duration required;
b) realised compressibility value too low→less intense compaction of particle material shot into the mould chamber required→reduced driving pressure, change in fluidizing behavior and/or shorter shot duration required; and
c) realised compressibility OK→possible reduction of shot duration by corresponding adjustment of fluidizing behavior and/or driving pressure or other "local" optimization.

In FIG. 1 the step 6.a of the method according to the present invention secures, that the physical and the logical activities are syncronised before the next shot is executed.

After this first cycles through the diagram in FIG. 1, the method according the present invention prescribes successive cycles carried out until the cycling is interrupted by a system monitoring for "flags" signaling stop of performing the method. Such flags might represent security warnings or emergency stop signals. Also shift in composition of poured metal and/or properties of supplied particle material might require intermediate stop of performance of the method to give in a new beneficial value for intended compressibility and/or mould chamber size/position.

As the duration of the shot normally is a dominating component directly affecting the overall cycle time of the machine 1 and as the ever-wanted optimization of the production normally is demanding minimization of cycle time, the above adaptive algorithms preferable might be organized in a hierarchy to first consume the possible reserve of "pressure" and/or "fluidizing" adjustments, before precious extra time for the shot duration is "consumed". If the drift of the properties of the sand delivered to the hopper 12 is of a relatively permanent character, the adaptive algorithms might need to shift between different parameters to first be "used up" by the successive adjustments intermediating the successive shots.

The exemplary embodiment shown in the figures are, of course, only intended to illustrate the principles of the present Invention without delimiting the scope thereof. Thus the method according to the present invention might be carried out in many different embodiments of an apparatus according to the present invention, such embodiment also comprising retrofitment to a machine, not hitherto being able to perform the method of the invention, of neccessary extra means allowing for realising the method according to the present invention, the scope of which is defined by the appending claims.

REFERENCE NUMBERS

1 apparatus, according to Disamatic®-principle
2 first movable wall
3 second movable wall
4 specific (start) position,(2)
5 specific (start) position,(3)
6 mould chamber
7 particle material (in hopper)
8 pressed mould
9 pattern plate, lining first wall
10 pattern plate, lining second wall
11 particle material inlet opening to mould chamber
12 pressurizable material hopper
13 detector, absolute linear position
14 detector, absolute linear position
15 pressing piston extension

16 measured position, pressing ended
17 measured position, pressing ended
18 top supply opening, hopper

The invention claimed is:

1. A method of producing a series of casting moulds or flaskless substantially horizontally stack-able mould parts in a series of cycles of operations of an apparatus fitted with a given set of corresponding pattern plates lining respectively two movable opposed walls in the generally box-shaped mould chamber in the apparatus, said method taking into account relatively slowly varying compaction properties of a particle material used over the series of cycles and securing a desired mould compressibility of the moulds or mould parts produced each cycle, said method comprising the following steps during each cycle of operation:

1. placing the opposed movable walls along a common axis of linear motion at individually specific wall starting positions relative to a particle material introduction reference point, the placing step thus defining an individually specific pattern starting position for each of the pattern plates which individual pattern starting position has been previously established as being beneficial and thus determining the wall starting positions;

the placing step of the movable walls to the individually specific wall starting positions being performed each cycle and before a shot of particle material is introduced into the mould chamber, such that the mould chamber has a same volume and position relative to the material introduction point before each succeeding shot of each cycle;

2. introducing of a shot of particle material into the mould chamber located at the individually specific wall starting positions, the introducing step controlling the amount of the shot of the particle material by controlling a parameter selected from one of a duration of the shot or a driving gas pressure profile of the shot, the introducing step initially controlling the parameter according to a beneficial reference starting parameter previously established as preferable, the parameter in succeeding cycles being adjusted as set forth hereafter;

3. pressing of the introduced shot of the particle material to form a mould by relative approach of the movable walls toward each other, the pressing step terminating at a specific pressing force/pressure, which is a fixed value previously being established as beneficial;

4. determining of a volume of the just pressed mould by determining of a distance between the movable walls after termination of the pressing step, 5. dislocating of the just pressed mould for later pouring with molten material, the dislocating step ending with the movable walls again defining the mould chamber in accordance with step 1.;

5.b1 calculating a resulted compressibility of the just pressed mould and a compressibility offset relative to the desired mould compressibility;

5.b2 adjusting, in response to the calculated resulted compressibility, the parameter as necessary in order to cause the compressibility offset expected for a next mould produced to be within specified limiting values;

5.b3 adjusting the apparatus according to any necessary adjustments determined in step 5.b2; and 6. repeating the steps starting at step 1.

2. The method according to claim 1, wherein the adaptive procedure used during step 5.b2 results in any necessary adjustment being made to the driving gas pressure profile, with the shot duration being kept unaltered.

3. The method according to claim 2, wherein the adaptive procedure used during step 5.b2 results in any necessary adjustment for one driving gas pressure of the driving gas pressure profile, the shot duration and possibly other driving gas pressures being kept unaltered.

4. The method according to claim 1, wherein the driving gas pressure profile is time-dependant.

* * * * *